US011323791B2

(12) United States Patent
Sato

(10) Patent No.: US 11,323,791 B2
(45) Date of Patent: May 3, 2022

(54) SOUND OUTPUT ASSEMBLY

(71) Applicant: YAMAHA CORPORATION, Hamamatsu (JP)

(72) Inventor: Akiyoshi Sato, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/938,392

(22) Filed: Jul. 24, 2020

(65) Prior Publication Data

US 2020/0359118 A1 Nov. 12, 2020

Related U.S. Application Data

(63) Continuation of application No. PCT/JP2018/002655, filed on Jan. 29, 2018.

(51) Int. Cl.

| | |
|---|---|
| ***H04R 1/02*** | (2006.01) |
| ***H04R 1/06*** | (2006.01) |
| ***H04R 1/32*** | (2006.01) |

(52) U.S. Cl.

CPC ..... *H04R 1/02* (2013.01); *H04R 1/06* (2013.01); *H04R 1/323* (2013.01)

(58) Field of Classification Search

CPC . H04R 1/025; H04R 1/06; H04R 1/28; H04R 1/2803; H04R 1/2873; H04R 1/2892; H04R 1/2896

See application file for complete search history.

(56) References Cited

U.S. PATENT DOCUMENTS

| | | | |
|---|---|---|---|
| 3,993,345 | A | 11/1976 | Croup |
| 5,640,461 | A | 6/1997 | Ebert |
| 6,104,823 | A | 8/2000 | Tanaka |
| 6,578,658 | B2 | 6/2003 | Jones |
| 7,292,706 | B2 | 11/2007 | Hamada |
| 8,009,850 | B2 | 8/2011 | Zhou |

(Continued)

FOREIGN PATENT DOCUMENTS

| | | | |
|---|---|---|---|
| JP | S48080536 | U | 10/1973 |
| JP | H03098594 | U | 10/1991 |

(Continued)

OTHER PUBLICATIONS

International Search Report issued in Intl. Appln. No PCT/JP2018/002655 dated Apr. 17, 2018 English translation provided.

(Continued)

*Primary Examiner* — Kile O Blair

(74) *Attorney, Agent, or Firm* — Rossi, Kimms & McDowell LLP

(57) ABSTRACT

A sound output assembly includes an enclosure, a circuit board disposed in the enclosure, and including signal processing circuitry, and a speaker assembly. The speaker assembly includes a main body disposed inside the enclosure, and a supporting member configured to support the main body and having (i) a first portion fixed to the main body such that the first portion of the supporting member and the main body are formed as one body and (ii) a second portion fixed to the circuit board or to the enclosure. The main body includes an acoustic diaphragm in accordance with a signal supplied from the signal processing circuitry. The supporting member is configured to dampen vibration of the main body.

4 Claims, 4 Drawing Sheets

(56) References Cited

U.S. PATENT DOCUMENTS

| | | | |
|---|---|---|---|
| 8,867,770 | B2 | 10/2014 | Chien |
| 10,469,925 | B2 | 11/2019 | Fukuhara |
| 2005/0194202 | A1 | 9/2005 | Ito |
| 2007/0121992 | A1 | 5/2007 | Nakagawa |
| 2009/0123017 | A1 | 5/2009 | Suzuki |
| 2009/0202095 | A1 | 8/2009 | Yano |
| 2012/0128197 | A1 | 5/2012 | Li |
| 2018/0139523 | A1 | 5/2018 | Takahashi |
| 2020/0162809 | A1 | 5/2020 | Honji |
| 2020/0221196 | A1 | 7/2020 | Dong |
| 2020/0359128 | A1 | 11/2020 | Sato |

FOREIGN PATENT DOCUMENTS

| | | | |
|---|---|---|---|
| JP | H08223679 | A | 8/1996 |
| JP | H10234091 | A | 9/1998 |
| JP | 2001352591 | A | 12/2001 |
| JP | 2004289221 | A | 10/2004 |
| JP | 2007151032 | A | 6/2007 |
| JP | 2009124234 | A | 6/2009 |
| WO | 2009144818 | A1 | 12/2009 |
| WO | 2017022254 | A1 | 2/2017 |

OTHER PUBLICATIONS

Written Opinion issued in Intl. Appln. No. PCT/JP2018/002655 dated Apr. 17, 2018.

International Search Report issued in Intl. Appln. No PCT/JP2018/002657 dated Apr. 17, 2018 English translation provided.

Written Opinion issued in Intl. Appln. No. PCT/JP2018/002657 dated Apr. 17, 2018. English translation provided.

Office Action issued in U.S. Appl. No. 16/938,292 dated Dec. 22, 2020.

Office Action issued in U.S. Appl. No. 16/938,292 dated Jun. 10, 2021.

Office Action issued in Japanese Appln. No. 2019-567804 dated Jun. 22, 2021. English machine translation provided.

Notice of Allowance issued in U.S. Appl. No. 16/938,292 dated Aug. 9, 2021.

Office Action issued in Japanese Appln. No. 2019-567803 dated Aug. 3, 2021. English machine translation provided.

Office Action issued in Chinese Appln. No. 201880087233.6 dated Aug. 4, 2021. English machine translation provided.

Office Action issued in Chinese Appln. No. 201880087187.X dated Jul. 21, 2021. Full English machine translation provided.

SOUND OUTPUT ASSEMBLY

CROSS REFERENCE TO RELATED APPLICATION

This Application is a Continuation Application of PCT Application No. PCT/JP2018/002655, filed Jan. 29, 2018, the entire contents of which are incorporated herein by reference.

BACKGROUND OF THE INVENTION

Field of the Invention

The present disclosure relates to the art of sound output assemblies.

Description of Related Art

There may be provided, in a car, for example, a sound output assembly that includes a speaker for output of sound. The sound output assembly is mounted to the interior of the car, and in accordance with a sound to be output processes an electrical signal for output of the sound.

In recent years, there has been developed a sound output assembly designed in an attempt to suppress vibrational noise resulting from transmission of vibration from the sound output assembly to the interior of the car. The sound output assembly includes an outer case and an inner case for housing a speaker, the inner case being provided within the outer case and a vibration absorber being interposed between the cases (see, for example, WO 2017/022254).

The conventional sound output assembly described is designed to suppress vibrational noise caused by transmission of vibration to the interior of a car. However, the conventional sound output assembly is subject to a drawback in that it is complex to build due to provision of the inner case within the outer case, which requires a large number of parts and incurs high cost.

SUMMARY

In view of the circumstances described above, the present disclosure has as its object provision of a sound output assembly that suppresses vibrational noise with use of fewer parts.

In order to achieve the object, a sound output assembly according to a first aspect of the present disclosure includes: an enclosure; a circuit board disposed in the enclosure, and including signal processing circuitry; and a speaker assembly, in which the speaker assembly includes; a main body disposed inside the enclosure, and a supporting member configured to support the main body and having (i) a first portion fixed to the main body such that the first portion of the supporting member and the main body are formed as one body and (ii) a second portion fixed to the circuit board or to the enclosure, in which the main body includes an acoustic diaphragm configured to produce a sound by vibrating in accordance with a signal supplied from the signal processing circuitry, and in which the supporting member is configured to dampen vibration of the main body.

DESCRIPTION OF EMBODIMENT

Figure 1:
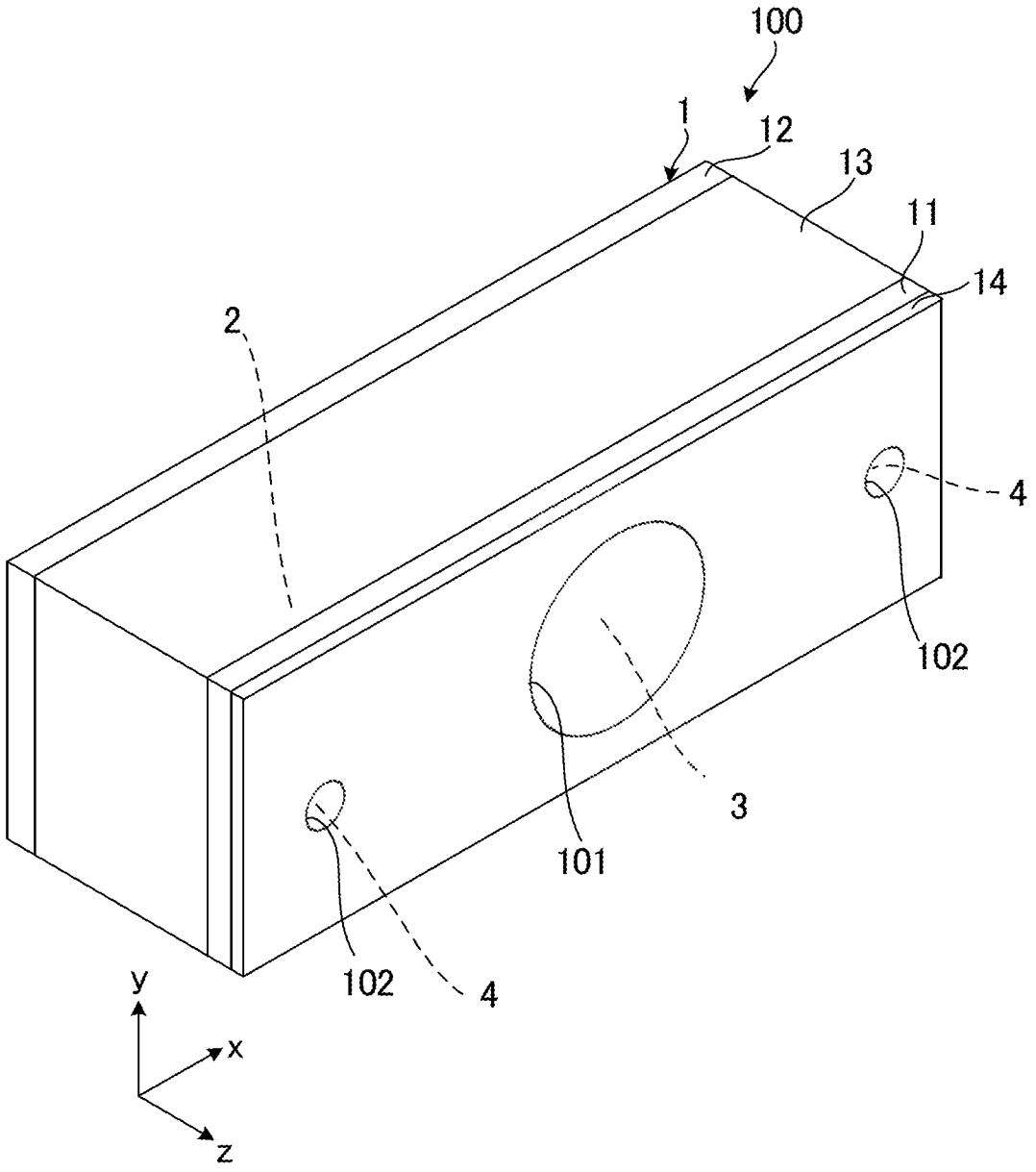
FIG. 1 is a perspective schematic diagram of a sound output assembly according to a first embodiment.

Embodiments of the present disclosure will be described below with reference to the drawings. It is of note that dimensions and scales of parts shown in the drawings may differ from those of actual products, as appropriate. In some of the drawings, select portions are depicted schematically for ease of understanding. The scope of the present disclosure is not limited to the following embodiments unless descriptions are included therein that particularly limit the present disclosure.

First Embodiment

Figure 2:
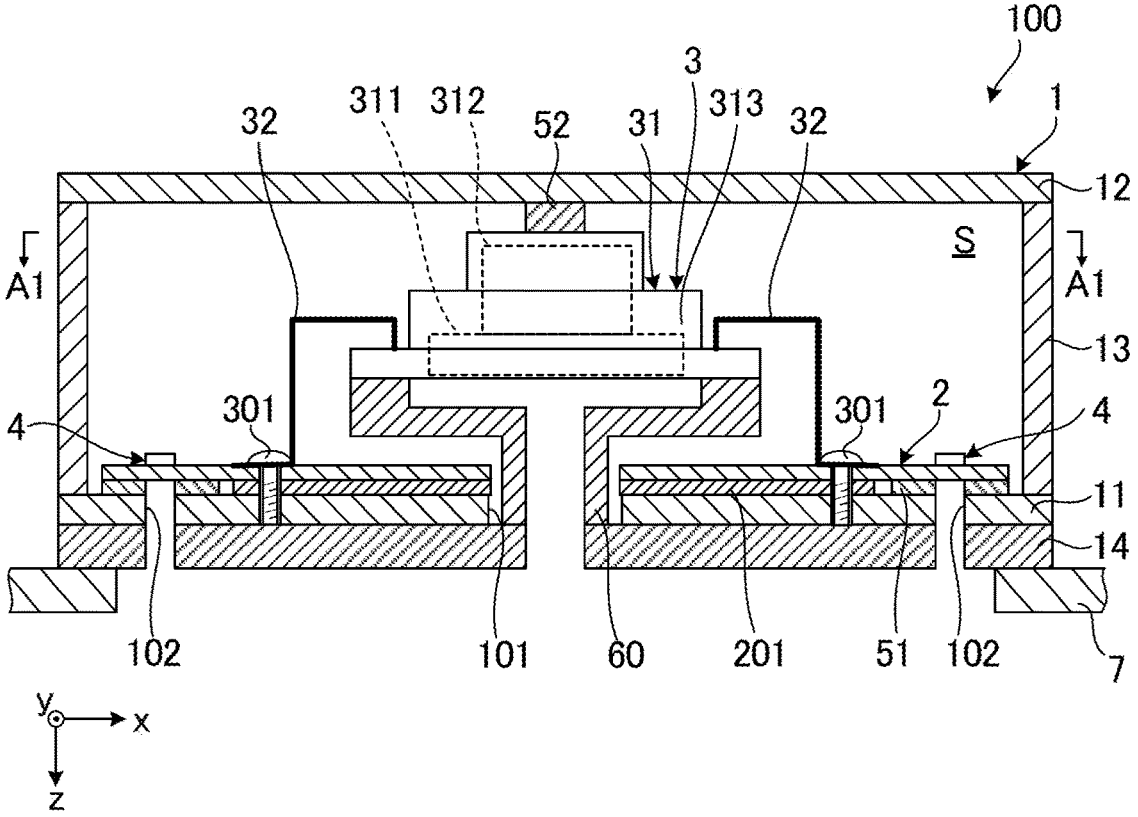
FIG. 2 is a cross-sectional view of the sound output assembly shown in FIG. 1.
Figure 3:
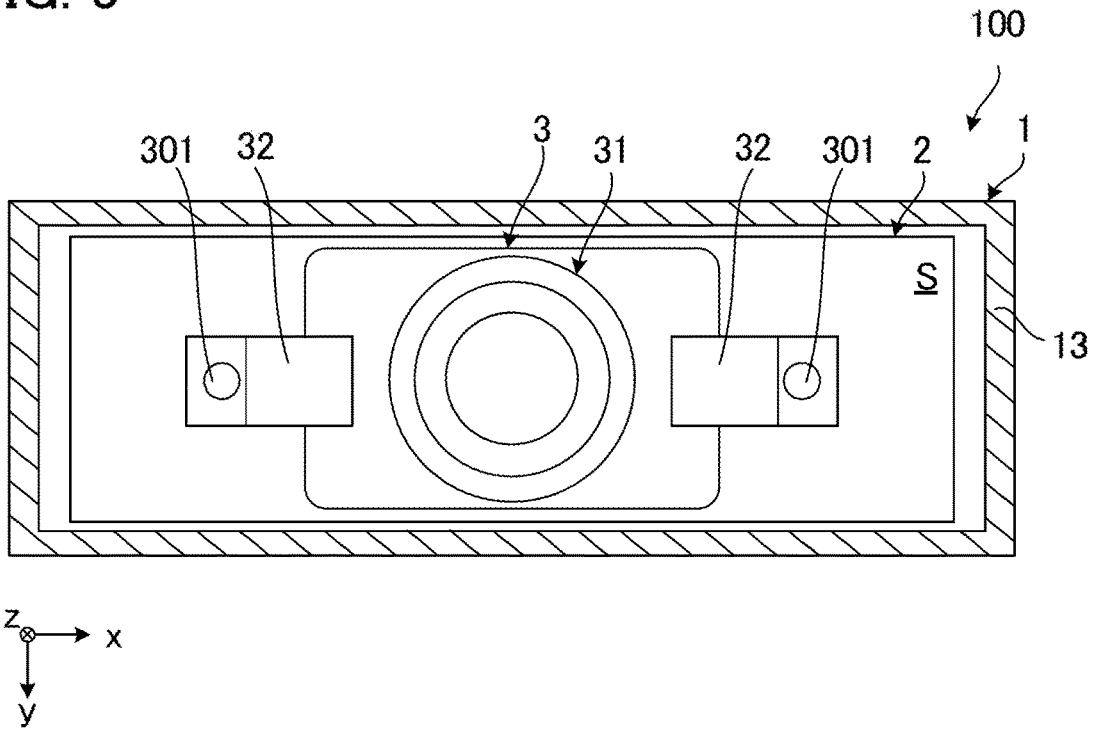
FIG. 3 is a planar view of the inside of the sound output assembly shown in FIG. 1.

FIG. 1 is a schematic perspective diagram of a sound output assembly according to the first embodiment. FIG. 2 is a cross-sectional view of the sound output assembly shown in FIG. 1. FIG. 3 is a cross-sectional view taken along a line A1-A1 in FIG. 2, and shows in planar view the interior of the sound output assembly. For ease of understanding of arrangement of parts, in each of the drawings there are shown perpendicular to one another an x-axis, a y-axis and a z-axis.

As shown in FIGS. 1 and 2, a sound output assembly 100 includes an enclosure 1, a circuit board 2 that is disposed inside the enclosure 1 and has signal processing circuitry, and a speaker assembly 3. The speaker assembly 3 is disposed inside the enclosure 1 and outputs a sound in accordance with an electrical sound signal. As shown in FIG. 2, the speaker assembly 3 includes a main body 31 and supporting members 32. The main body 31 includes an acoustic diaphragm 311. The main body 31 causes the acoustic diaphragm 311 to vibrate and output a sound in accordance with the electrical sound signal. The supporting members 32 support the main body 31, and damp vibration of the enclosure 1. The sound output assembly 100 further includes microphones 4 disposed inside the enclosure 1. Each of the microphones 4 converts a sound to a sound signal. The sound output assembly 100 can be described as "a sound input/output device." In FIG. 3, illustration of the microphones 4 is omitted.

The sound output assembly 100 may be used as a hands-free call device. The sound output assembly 100 is configured to communicate with a user's cell phone either by wireless or wired connection. The sound output assembly 100 receives a voice of the user via the microphones 4, and converts the received voice to a sound signal. The sound output assembly 100 also outputs a sound of a communicating person by use of the speaker assembly 3. For example, the sound output assembly 100 receives a sound signal of a voice of the communicating person received through the user's cell phone and applies processing such as amplification to the received sound signal for output of a sound. The sound output assembly 100 converts a voice produced by the user to a sound signal, and transmits to the user's cell phone the sound signal to which the processing such as amplification is applied. The sound signal transmitted from the sound output assembly 100 to the user's cell phone is transmitted to the communicating person's cell phone.

The sound output assembly 100 may be used in the interior of a car, for example. In this case, as shown in FIG. 2, the sound output assembly 100 is mounted to an object 7, such as an interior part of the car. Construction of the elements of the sound output assembly 100 is described below. Hereafter, an exemplary case will be described in which the sound output assembly 100 is installed in the interior of the car. Throughout this specification, "planar view" refers to the view from the z-axis.

Enclosure

The enclosure 1 is constituted of different members, and has a box shape. The enclosure 1 has an inner space S for housing the circuit board 2 and the speaker assembly 3. The enclosure 1 is detachable from the object 7. For example, the enclosure 1 is detachably attached to the object 7 by bonding, fitting or the like. The shape of the enclosure 1 is not limited to that illustrated in the drawings. For example, the enclosure 1 may have a cylindrical shape.

The enclosure 1 includes a first member 11 that has a square flat shape, a second member 12 that has a square flat shape and is provided apart from the first member 11, and a third member 13 that has a square tube shape and is positioned between the first member 11 and the second member 12. In the embodiment, the enclosure 1 is formed from the first member 11, the second member 12 and the third member 13 that are separated from each other, and these members are connected to each other by bonding, fitting or other similar means. However, the enclosure 1 may be formed as a single piece of these members.

The first member 11 has an opening 101. The opening 101 causes a sound output from the speaker assembly 3 to be directed to the outside of the enclosure 1. The opening 101 is provided at the center of the first member 11. The first member 11 is also provided with two openings 102 that direct a voice of the user to the microphones 4. As seen in planar view, the openings 102 are provided in the first member 11 on either side of the opening 101.

A member 14 of the same shape as that of the first member 11 is provided on an outer surface of the first member 11 such that the member 14 does not block the opening 101 or the openings 102. The member 14 acts to increase union between the enclosure 1 and the object 7. The member 14 is interposed between the object 7 and the first member 11 with close contact therebetween, and the object 7 is attached to the enclosure 1.

Upon attachment of the object 7 to the enclosure 1, the member 14 closely conforms to the shape of the object 7 such that no gap exists between the object 7 and the enclosure 1. As a result, undesirable acoustic variations are inhibited.

Examples of a material that can be used for the member 14 include a rubber, a soft resin, a porous structure (e.g., a closed-cell sponge material and an open-cell sponge), and a jelly-like material. Preferable as use for the member 14 from among these materials is a closed-cell sponge material, due to its high impact resilience. Also use of this, material for the member 14 inhibits undesirable acoustic variations. The closed-cell sponge material is also advantageous over the other example materials in that it is readily available and easy to handle.

An employed material of each of the first member 11, the second member 12 and the third member 13 is not limited thereto. Examples of an employed material of these include various resin or other similar materials.

Circuit Board

The circuit board 2 is adhered to the first member 11 with, for example, adhesive members 201 supplemented with fixing screws 301. The adhesive members 201 may be formed from, for example, double-sided adhesive tape. The circuit board 2 is equipped with integrated circuitry (IC) including signal processing circuitry that amplifies a sound signal and carries out a variety of signal processing. The circuit board 2 is also equipped with various communication modules, such as a module that receives and transmits the sound signal.

Between the circuit board 2 and the first member 11 there are interposed vibration absorbers 51 (second vibration absorbers), which act to absorb vibration. The vibration absorbers 51 are provided at a portion on the first member 11 separate from that at which the adhesive members 201 are provided. As seen from the planar view in the drawings, the vibration absorbers 51 are positioned outward of the adhesive members 201. The provision of the vibration absorbers 51 between the circuit board 2 and the first member 11 effectively reduces transmission of vibration from the circuit board 2 to the enclosure 1. Furthermore, vibration transmitted to the microphones 4 provided on the circuit board 2 through the first member 11 is effectively reduced. The same example material as used for the above-mentioned member 14 may be used for the vibration absorbers 51, or one different to that above-mentioned used for the member 14 may be used. However, from a view point of simplicity of design and cost savings, it is preferable that the vibration absorbers 51 be made of the same material as that of the member 14, and that each be made of the closed-cell sponge material.

The number of the circuit boards 2 and an arrangement thereof are not limited to the examples shown in the drawings, and are freely selectable. The circuit board 2 may be, for example, positioned on the inner side of the second member 12; and more than one of the circuit board 2 may be used.

Microphones

Two microphones 4 are provided on the circuit board 2. The two microphones 4 have a one-to-one correspondence with the two openings 102. The microphones 4 are disposed such that the speaker assembly 3 is positioned between the two microphones 4.

Each of the microphones 4 converts a voice of the user to an electrical sound signal. The thus generated electrical signal is output to the signal processing circuitry on the circuit board 2. Examples of each of the microphones 4 include a Micro-Electrical-Mechanical System (MEMS). The number of the microphones 4 and an arrangement thereof are not limited to the examples shown in the drawings.

Speaker Assembly

The speaker assembly 3 is disposed between the circuit board 2 and the second member 12, and is positioned apart from both the circuit board 2 and the enclosure 1. As described above, the speaker assembly 3 has the main body 31 including the acoustic diaphragm 311, and the supporting members 32, which are integral with the main body 31.

Main Body

The sound signal supplied from the signal processing circuitry on the circuit board 2 is caused by the main body 31 to vibrate the acoustic diaphragm 311 and generate a sound wave, i.e., a sound. As shown in FIG. 2, the main body 31 includes, in addition to the acoustic diaphragm 311, a driver 312 that causes the acoustic diaphragm 311 to vibrate, and a frame 313 that houses the driver 312. The acoustic diaphragm 311 consists of a membrane that vibrates in accordance with the sound signal. This sound output assembly 100 is dynamic type. However, the construction of the sound output assembly 100 is not limited thereto. In the dynamic type, the driver 312 is constituted of a permanent magnet and a voice coil, and the acoustic diaphragm 311 is connected to the voice coil. The acoustic diaphragm 311 may be of a plate shape or a cone shape.

The acoustic diaphragm 311 is disposed between the first member 11 and the second member 12 at a position that corresponds to a position of the opening 101. Otherwise stated and more specifically, the opening 101 is provided at a position that corresponds to a position of the acoustic diaphragm 311 such that a sound output from the acoustic diaphragm 311 is directed toward the outside of the enclosure 1. A gasket 60 is provided between the main body 31 and the first member 11, as a cover member, for ensuring airtightness therebetween.

Supporting Members

Figure 4:
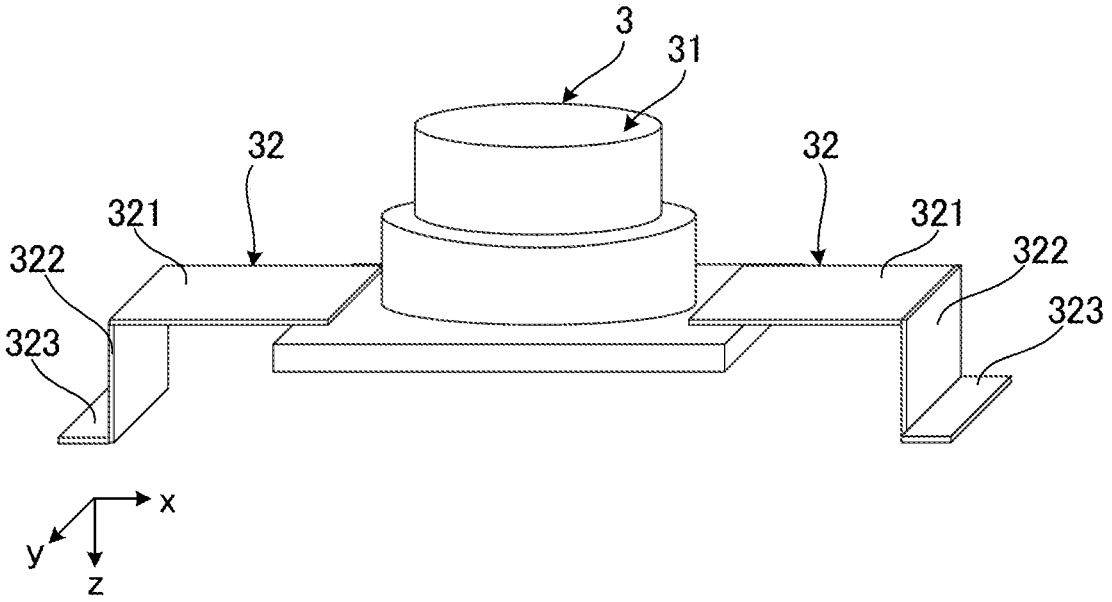
FIG. 4 is a perspective view showing a speaker assembly shown in FIG. 2.

FIG. 4 is a perspective view showing the speaker assembly shown in FIG. 2. As shown in FIG. 4, the main body 31 is provided with two supporting members 32. The two supporting members 32 are disposed on either side of the main body 31. As shown in FIG. 2, the supporting members 32 are mounted on the circuit board 2, to support the main body 31. The supporting members 32 damp vibration of the main body 31.

As shown FIG. 4, each of the supporting members 32 has a bent shape formed that is defined by multiple bends of a long plate-shaped member along its longitudinal direction. Specifically, each of the supporting members 32 is a plate spring that is formed from a sheet metal. Each of the supporting members 32 has a part 321, a part 322 and a part 323. As shown on the right in FIG. 4, in one of the supporting members 32, the part 321 extends away from the speaker assembly 3 in the positive x direction; the part 322 extends from a fold between the part 322 and the part 321 in the positive z direction; and the part 323 extends from a fold between the part 322 and the part 323 in the positive x direction. As shown on the left in FIG. 4, in the other supporting member 32 the part 321 extends away from the speaker assembly 3 in the negative x direction; the part 322 extends from the fold between the part 322 and the part 321 in the positive z direction; and the part 323 extends from a fold in between the part 322 and the part 323 in the negative positive x direction. As shown in FIG. 2, each of the supporting members 32 has two ends. One end of each of the supporting members 32 is integrally connected to the main body 31. That is, each of the supporting members 32 and the main body 31 are formed as one body. The other end of each of the supporting members 32 is fixed to the circuit board 2 with a screw 301. As used here, the description "the supporting members 32 and the main body 31 are formed as one body" does not include a case in which the supporting members 32 are attachable to or detachable from the main body 31. The supporting members 32 and the main body 31 may be formed as a single body by welding, by molding, by bonding with adhesive, or by bonding with a double-sided adhesive tape. In the embodiment, each of the supporting members 32 is connected to the frame 313 of the main body 31 by welding. A metallic material for welding the frame 313 is used for joints between the frame 313 and the supporting members 32.

As mentioned above, the provision of the supporting members 32, each of which is formed by a plate-shaped member, enables vibration of the main body 31 to be damped by use of a relatively simple configuration. This construction results in damping of vibration that travels not only from the main body 31 to the circuit board 2 through the supporting members 32, but also from the circuit board 2 to the enclosure 1. Furthermore, since the supporting members 32 are thin they elastically deform with ease, thereby enabling effective damping of vibration of the main body 31.

Since the main body 31 and the supporting members 32 are formed as one body, vibration of the main body 31 is more effectively damped, as compared to a case in which they are provided separate from each other. Furthermore, since an additional member for fixing together the main body 31 and the supporting members 32 is not required, a configuration of the sound output assembly 100 can be simplified.

In this embodiment, each of the supporting members 32 serves as an electrode for supplying the sound signal output from the signal processing circuitry on the circuit board 2 to the main body 31. Since each of the supporting members 32 is used as an electrode, there is no need for use of electrodes additional to the supporting members 32. As a result, compared to the configuration of the second embodiment described later, a number of parts used can be reduced. In particular, in this embodiment, each of the supporting members 32 is constructed from a thin plate spring that readily bends. Use of the plate spring provides support for the main body 31, while also enabling the supporting members 32 that act as electrodes to be shaped with ease.

In the sound output assembly 100, the mass of the speaker assembly 3 in conjunction with a compliance of the supporting members 32 and a compliance of air present within the inner space S of the enclosure 1 acts as a low-pass filter. An input to the low-pass filter corresponds to a force for driving the acoustic diaphragm 311, and an output from the low pass-filter corresponds to a force for driving the circuit board 2. Thus, it is preferable that the thickness of the supporting members 32, the shape thereof, the material used to form the same and other relevant factors be determined with a view to creation of a viable low-pass filter as construed in the preceding description. In this way vibration transmitted to the circuit board 2 and the enclosure 1 can be damped. As a result, it is possible to reduce vibrational noise of the object 7 resulting from transmission of vibration propagation from the enclosure 1 to the object 7.

As stated, each of the supporting members 32 is formed from the plate spring. However, a material for each of the supporting members 32 is not limited thereto, and may be, for example, a spiral spring or other similar spring. The primary role of the supporting members 32 is to damp vibration damping, and thus it is preferable that each of the supporting members 32 be elastic and formed from a thin, narrow and long member, to provide effective damping of vibration. The number of the supporting members 32 is not limited to two, and may be one only, or more than three. An arrangement of the supporting members 32 is not limited to that illustrated in the drawings. However, in a case in which there are provided a plurality of the supporting members 32 to ensure stable support of the main body 31, it is preferable that the supporting members 32 be arranged equidistant from each other. Furthermore, the supporting members 32 may each be of the same configuration or may each be of a different configuration. For example, among the plurality of the supporting members 32, one or more supporting members may be used as an electrode, with the remainder being used for damping only.

A vibration absorber 52 (a first vibration absorber) is interposed between the main body 31 and the second member 12 of the enclosure 1. As seen in planar view, the vibration absorber 52 is positioned at the center of the speaker assembly 3. This construction enables the main body 31 to remain stable within the enclosure 1, as compared to a case in which the vibration absorber 52 is not provided. Furthermore, this construction enables vibration transmitted to the main body 31 to be effectively absorbed. As a result, it is possible to reduce vibrational noise of the object 7 caused by transmission of vibration from the main body 31 to the object 7 through the enclosure 1.

The same exemplary material employed in the above-mentioned member 14 can also be used for the vibration absorber 52. The vibration absorber 52 may be made of the same material as the member 14 and the vibration absorbers 51, or each may be made of a different material. In the drawings, the vibration absorber 52 is shown only at a single space between the main body 31 and the enclosure 1. However, the vibration absorber 52 may be provided along the entire length therebetween.

As explained in the foregoing, the sound output assembly 100 includes the enclosure 1, the circuit board 2 disposed in the enclosure 1 and including the signal processing circuitry, and the speaker assembly 3. The speaker assembly 3 includes the main body 31 disposed inside the enclosure 1, and the supporting members 32. The supporting members 32 are formed integral with the main body 31, are disposed on the circuit board 2, and support the main body 31. The main body 31 includes an acoustic diaphragm configured to produce a sound by vibrating in accordance with a signal supplied from the signal processing circuit. The supporting members 32 are configured to damp vibration of the main body 31.

Since the sound output assembly 100 includes supporting members 32 described above, vibration of the main body 31 is damped. This results in damping of the vibration traveled not only to the circuit board 2, but also to the enclosure 1 through the supporting members 32. Consequently, it is possible to reduce vibrational noise of the object 7 that results from transmission of vibration from the main body 31 to the object 7. Since the main body 31 and the supporting members 32 are formed as one body, vibration of the main body 31 is more effectively damped, as compared to a case in which they are provided separate from each other. Furthermore, the provision of the supporting members 32 enables vibration transmitted from the main body 31 to the object 7 to be damped. As a result, vibration of the microphones 4, which is caused by transmission of vibration from the main body 31 to the microphones 4 via the enclosure 1, is damped. Consequently, vibrational noise of the microphones 4 is also reduced. The reduction of vibrational noise provides an improvement in the sound of the sound output assembly 100. Since the supporting members 32 and the main body 31 are formed as one body, there is no requirement to provide two kinds of members separately: members for supporting the main body 31 and members for vibration damping. Therefore, a number of parts and costs are reduced.

In the embodiment, the supporting members 32 are connected to the circuit board 2. However, the supporting members 32 may be connected to the enclosure 1. Such a configuration also enables vibrational noise of the object 7 to be reduced that results from transmission of vibration from transmission of vibration from the main body 31 to the object 7 through the enclosure 1. As long as the supporting members 32 are connected to the enclosure 1, each of the supporting members 32 may be connected to any one of the first member 11, the second member 12 and the third member 13.

As described in the foregoing, since the low-pass filter is formed by the mass of the speaker assembly 3 in conjunction with the supporting members 32 and the air present inside the inner space S of the enclosure 1, the amount of vibration transmitted to the enclosure 1 is reduced. Accordingly, it is possible to reduce vibrational noise of the object 7 that results from transmission of vibration from the enclosure 1 to the object 7. The reduction in vibrational noise provides an improvement in the sound quality of the sound output assembly 100.

As described in the foregoing, the sound output assembly 100 includes, in addition to the supporting members 32, the vibration absorber 52. The combination of the supporting members 32 having elastic properties and the vibration absorber 52 having vibration absorbing properties imparts a synergistic effect, whereby the object 7 produces significantly less vibrational noise that results from transmission of vibration. Furthermore, as described in the foregoing, the sound output assembly 100 includes the member 14. The member 14 is connected to the gasket 60. Accordingly, the member 14 acts to absorb vibration of the gasket 60 that is connected to the main body 31. The provision of the member 14 in addition to the supporting members 32 enables effective reduction in vibrational noise of the object 7. A material used for vibration absorber 52, and that used for the member 14, along with a shape of each of the supporting members 32 can be preferentially selected. This preferable selection allows for less noise generated by the vibration of the object 7.

The foregoing sound output assembly 100 is also able to output a musical sound or other similar sounds.

Second Embodiment

Figure 5:
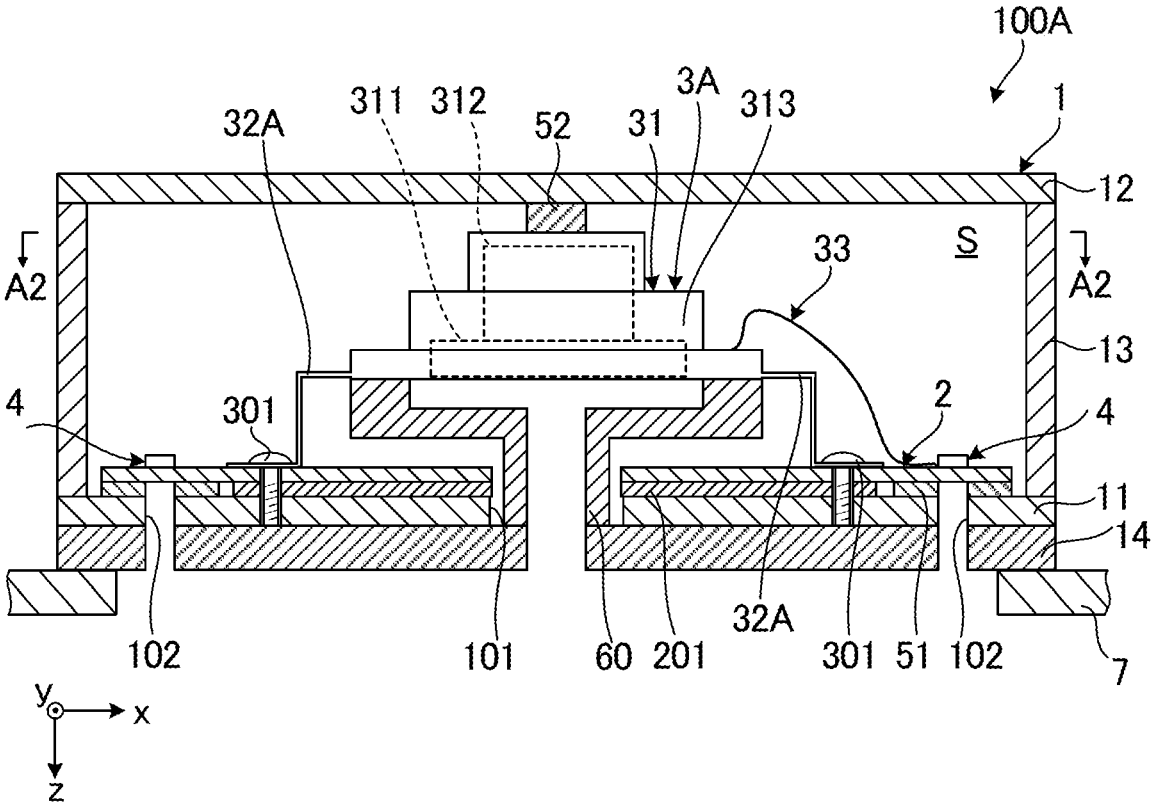
FIG. 5 is a cross-sectional view of a sound output assembly according to a second embodiment.
Figure 6:
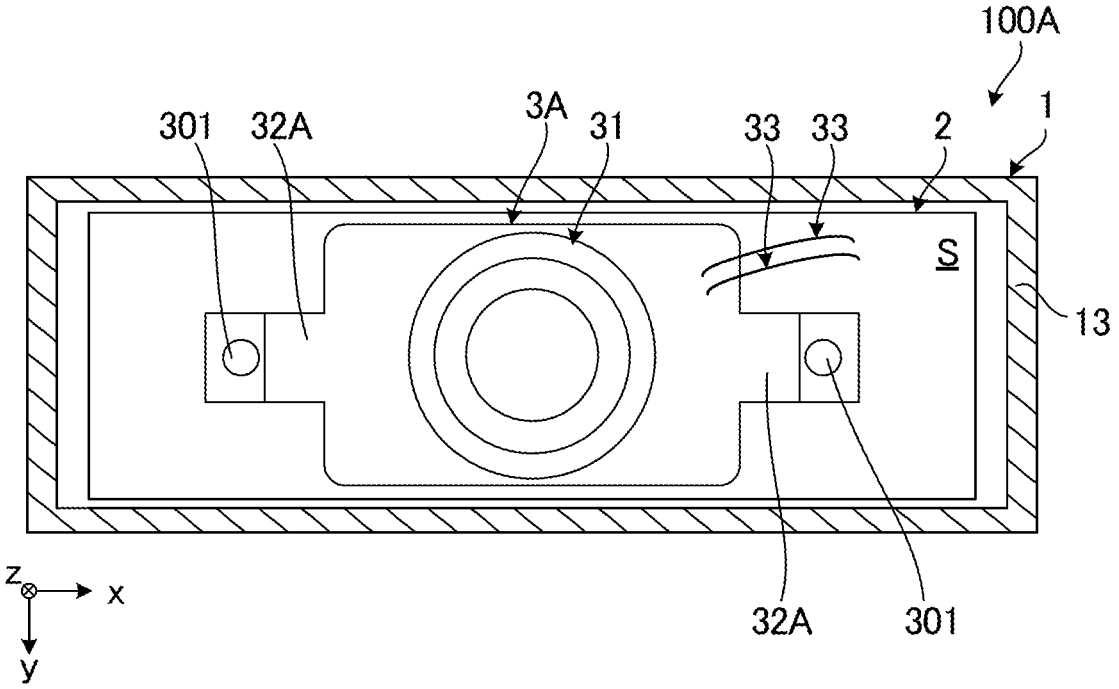
FIG. 6 is a planar view of the inside of the sound output assembly shown in FIG. 5.

Next, the second embodiment according to the present disclosure now will be described. FIG. 5 is a cross-sectional view of a sound output assembly according to the second embodiment. FIG. 6 is a cross-sectional view taken along A2-A2 in FIG. 5, and shows an inside of the sound output assembly in planar view.

The sound output assembly according to the second embodiment is substantially the same as that in the first embodiment described above, with exceptions that there are provided (A) supporting members having different structures from those in the first embodiment, and (B) wires.

The following description of the second embodiment mainly focuses on these points of difference comparative to the first embodiment; aside from these points of difference matters common to the first embodiment are described. In FIGS. 5 and 6 illustrating the second embodiment, the same components depicted in the first embodiment are denoted by the same reference signs.

As shown in FIGS. 5 and 6, a sound output assembly 100A includes a speaker assembly 3A and supporting members 32A. The main body 31 and the supporting members 32A are formed as one body. Specifically, the main body 31 includes the frame 313. The frame 313 and the supporting members 32A are formed as one body. The frame 313 and the supporting members 32A are made from a resin or a metal, for example.

The supporting members 32A according to the second embodiment differ from the supporting members 32 according to the first embodiment in that none of the supporting members 32 is used as an electrode. Alternatively, the sound output assembly 100A according to the second embodiment includes wires 33 for connecting the main body 31 to the circuit board 2. The number of the wires 33 is not limited to two shown in the drawings, and may be number one or more than three. The wires 33 supply a sound signal, which is output from the signal processing circuitry on the circuit board 2, to the driver 312 in the main body 31. As such, the provision of the wires 33 enables to greater freedom of design for the supporting members 32A, as compared to the structure of the supporting members 32 according to the first embodiment. Accordingly, the second embodiment facilitates a design for a structure that effectively reduces vibration, and reduces costs.

In the second embodiment, each of the supporting members 32A has a bent shape, which is obtained by a long plate-shaped member being bent multiple times. However, the shape of each of the supporting members 32A is not limited thereto, and may be a spiral shape, a mesh shape or other appropriate shapes.

As explained in the foregoing, the configuration according to the second embodiment reduces vibrational noise and a number of parts used.

Although the sound output assemblies according to the present disclosure are explained based on the embodiment shown in the drawings, the present disclosure is not limited thereto. Components according to the present disclosure may be replaced with other freely selected components that have the same function as those described in the embodiments, and different selected components may be freely combined. In the present disclosure, freely selected components in each of the foregoing embodiments may be combined with one another.

In the foregoing embodiments, an exemplary case is described in which each of the sound output assemblies includes microphones. However, the present disclosure need not include microphones.

In the foregoing embodiments, an exemplary case is described in which the sound output assemblies are employed in vehicles such as cars. However, the sound output assembly may be employed other than in vehicles such as cars. For example, the sound output assembly may be mounted to an inner wall of a building.

The following aspects of the present disclosure are derivable from the embodiments exemplified above.

A sound output assembly according to a preferred aspect of the present disclosure includes an enclosure; a circuit board disposed in the enclosure, and including signal processing circuitry; and a speaker assembly, in which the speaker assembly includes; a main body disposed inside the enclosure, and a supporting member configured to support the main body and having (i) a first portion fixed to the main body such that the first portion of the supporting member and the main body are formed as one body and (ii) a second portion fixed to the circuit board or to the enclosure, in which the main body includes an acoustic diaphragm configured to produce a sound by vibrating in accordance with a signal supplied from the signal processing circuitry, and in which the supporting member is configured to dampen vibration of the main body.

According to this aspect, the provision of the supporting member described above enables vibration of the main body to be damped. This results in damping of vibration that travels to the main body or the circuit board through the supporting member. As a result, even when the sound output assembly is attached to an object, it is possible to reduce noise generated by vibration of the object resulting from vibration transmitted from the main body to the object. Furthermore, since each of the supporting member is formed integral with the main body, this aspect enables a number of parts used and costs incurred to be reduced.

In the preferred aspect of the sound output assembly described above, the sound output assembly further includes a wire electrically connecting the main body to the circuit board.

This aspect enables to improve freedom of design for the supporting member.

In the preferred aspect of the sound output assembly described above, the second portion of the supporting member is fixed to the circuit board, and the supporting member acts as an electrode that supplies the signal from the signal processing circuitry to the main body.

Since the supporting member is used as the electrode, this aspect does not require other electrodes other than the supporting member. No provision of other electrodes enables to reduce the number of parts.

In the preferred aspect of the sound output assembly described above, the speaker assembly, the supporting member, and air inside the enclosure are configured to act as a low pass filter.

This aspect enables to reduce vibration that travels to the main body or the circuit board more effectively. As a result, noise is reduced more effectively.

In the preferred aspect of the sound output assembly described above, the supporting member has a plate shape.

Even if vibration of the main body travels to the enclosure or the circuit board, this aspect enables to reduce vibration of the main body or the circuit board with relatively simple configuration. The term "plate shape" is intended to include a bent shape or a curved shape, in addition to the flat shape.

In the preferred aspect of the sound output assembly described above, the sound output assembly further includes vibration absorber configured to absorb the vibration of the main body, in which the vibration absorber is disposed between the enclosure and the main body.

According to this aspect, the provision of the vibration absorber enables the main body to be steady in the enclosure, and allows for absorbing vibration that travels from the main body to the enclosure, as compared to no provision of the vibration absorber. As a result, it is possible to reduce noise generated by vibration of the object resulting from the vibration propagation from the main body to the object through the enclosure.

In the preferred aspect of the sound output assembly described above, the first portion of the supporting member and the main body are formed as one body by the first portion of the supporting member being welded directly to the main body.

In the preferred aspect of the sound output assembly described above, the first portion of the supporting member and the main body are formed as one body by the first portion of the supporting member being integrally formed with the main body.

DESCRIPTION OF REFERENCE SIGNS

1 . . . enclosure, 2 . . . circuit board, 3 and 3A . . . speaker assembly, 31 . . . main body, 7 . . . object, 32 and 32A . . . supporting member, 33 . . . wire, 52 . . . vibration absorber (a first vibration absorber), 100 and 100A . . . sound output assembly, 311 . . . acoustic diaphragm

What is claimed is:

1. A sound output assembly comprising:

an enclosure having an opening and being configured to be detachably mountable to an automobile;

a circuit board disposed in the enclosure, and including signal processing circuitry;

a gasket; and a speaker assembly, wherein the speaker assembly includes;

a main body disposed inside the enclosure, and a supporting member configured to support the main body and having (i) a first portion fixed to the main body such that the first portion of the supporting member and the main body are formed as one body and (ii) a second portion fixed to the circuit board or to the enclosure, wherein the main body includes an acoustic diaphragm disposed at a position corresponding to the opening in the enclosure and being configured to produce a sound by vibrating in accordance with a signal supplied from the signal processing circuitry, wherein the supporting member is configured to dampen vibration of the main body, wherein the gasket is disposed between the main body and the enclosure and provides an airtight seal between the main body and the enclosure by sealing a gap between a peripheral edge of the opening and the speaker assembly, and wherein the enclosure includes a first vibration absorbing member, the enclosure being configured to be detachably mountable to the automobile via the first vibration absorbing member.

2. The sound output assembly according to claim 1, further comprising a second vibration absorbing member disposed between the enclosure and the main body.

3. The sound output assembly according to claim 2, wherein the second vibration absorbing member directly contacts the enclosure and the main body.

4. The sound output assembly according to claim 3, wherein the gasket directly contacts the main body and the first vibration absorbing member.

* * * * *